United States Patent [19]

Graham et al.

[11] 4,342,141

[45] Aug. 3, 1982

[54] BULLET MOLD DEVICE

[76] Inventors: James J. Graham, 503 - 36th Ave., Greeley, Colo. 80631; Edward Earl, 1316 Edwina Pl., Loveland, Colo. 80537

[21] Appl. No.: 119,122

[22] Filed: Feb. 6, 1980

[51] Int. Cl.[3] ..... C06B 21/02; F42B 33/10

[52] U.S. Cl. ..... 29/1.22; 86/1 R

[58] Field of Search ..... 29/1.22, 1.21; 86/1, 86/10, 21, 24, 28, 33; 164/70, 137, 264, 342

[56] References Cited

U.S. PATENT DOCUMENTS

| | | | |
|---|---|---|---|
| 2,930,483 | 3/1960 | Kaul | 29/1.21 |
| 3,249,980 | 5/1966 | Eisenman | 29/1.22 |
| 3,745,873 | 7/1973 | Lee | 29/1.22 |

*Primary Examiner*—Horace M. Culver

*Attorney, Agent, or Firm*—Wilbur A. E. Mitchell

[57] ABSTRACT

A single bullet tool for casting, shearing and molding bullet balls, comprising a mold for forming lead sticks, means for shearing off a lead slug from such stick, and means for forming a cold formed bullet ball of such slug and for removing the sprue excess formed around the bullet and for sizing the bullet to the desired diameter.

7 Claims, 11 Drawing Figures

BULLET MOLD DEVICE

SUMMARY OF INVENTION

Figures 1, 2, 3:
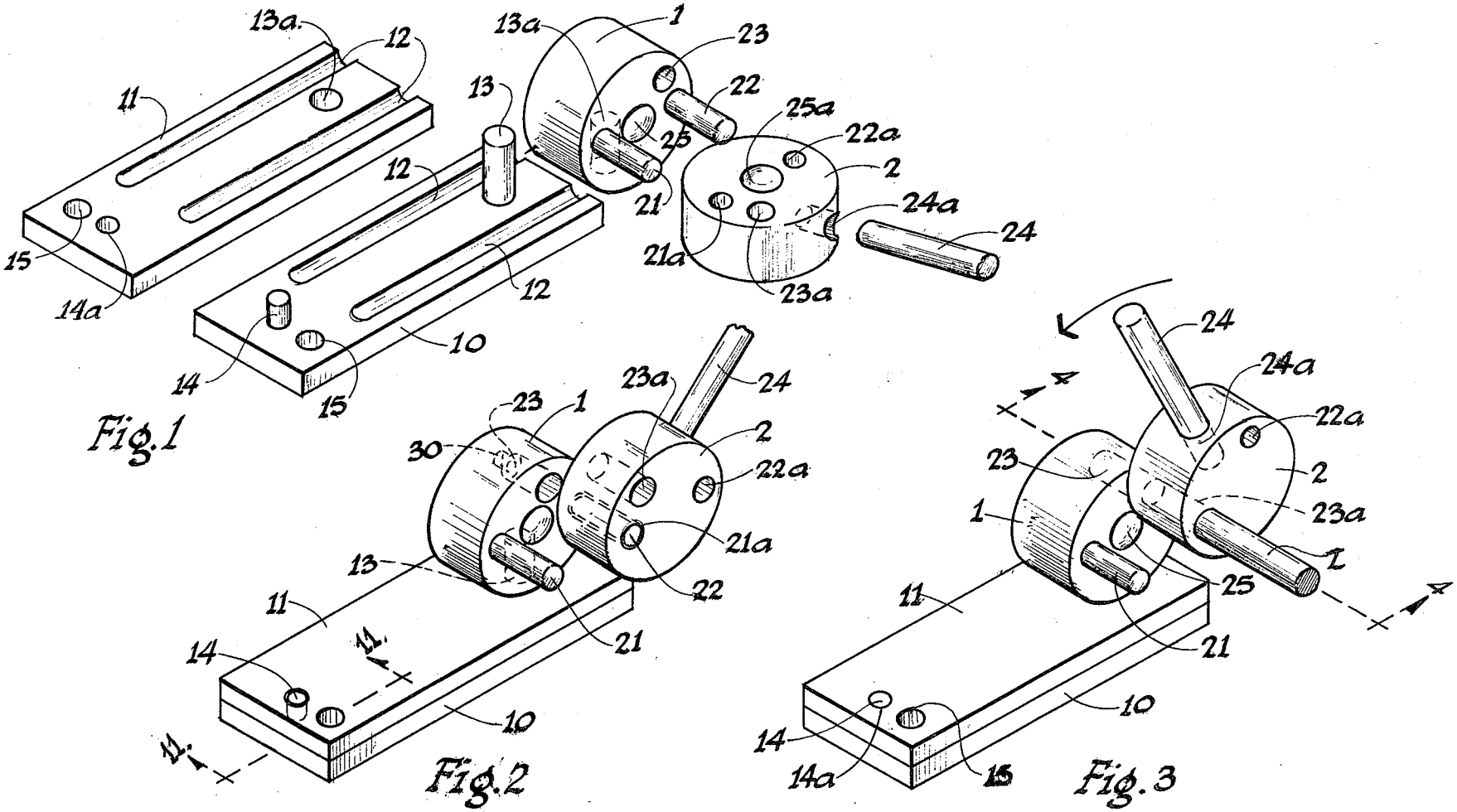

Our invention is an improvement in Bullet Molds. We have perfected a one unit device for casting, shearing and molding rifle or pistol balls, such as of lead. Heretofore, a plurality of tools has been required to mold the lead into sticks, another to cut the desired slug pieces from such a stick, another tool to swage the lead slug into a bullet shape, and another to trim off the excess sprue metal usually formed on the bullet in that swaging. We have developed one tool to do all those.

Our tool comprises:

(a) A pair of base plates with one plate having posts and the other plate having openings for receiving the posts, with the plates, slidably held together by the posts, with each plate having several half cavity cylindrical areas formed in parallel arrangement therein, when the plates are held in alignment together with the cavities opposing each other. An aligned pair of the opposing cavities comprise a mold for receiving molten lead therein to form the desired size lead stick. One of base plate dowell posts extends beyond the other plate. The base plates are adapted for separation to be able to remove the lead sticks therefrom when the molten lead cools;

(b) A pair of flat like circular dies, preferrably of heat treated cold rolled low carbon steel;

A first one of said dies having an opening formed and extending radially inwardly from its periphery for adapting the die to have a dowell post of the base plate slidably inserted into said opening, when the die is placed with that opening over that dowell post of the plate, for removably holding the die onto that post. That first die has a pair of parallel diametrically opposed spaced apart dowell pins secured thereto and extending outwardly from and secured to a flat side face portion of the die. A substantially one-half ball cavity is formed in said first die flat face at its center and between said two dowell pins. A transverse hole is formed as a bullet slug cavity through this die near its periphery and of a size sufficient to receive a lead stick inserted therein. An adjustably operable screw plug is provided within that transverse die opening on the side thereof opposite from the bullet cavity side of the die. Said plug is adapted for operation in its opening to limit the extent of insert of such a lead stick.

The second one of said dies has a diametrically opposed spaced apart pair of transverse openings formed therethrough in spaced apart parallel relationship for adapting the second die to be placed with a flat surface flush against said flat side of the first die by slidable insert of said pair of dowell pins of the first die within said pair of second die openings. The second die has a similar central one-half ball cavity formed in its center between said two openings on one of its flat surfaces and between said two openings. The second die has a transverse third opening formed therethrough adjacent its periphery, of equal size to the opening for the lead stick of the first die, for receiving a lead stick to be inserted therethrough. The second die has a radial opening formed on its periphery and extending inwardly, for purpose of receiving a handlebar slidably inserted therein, and on the periphery of this die between said opening for receiving the lead stick and one of said dowell pin pair of aligned openings; and (c) One of said base plates having a cylindrical trimming opening formed therethrough of a restricted inside diameter equal to the exact diameter of the finished ball bullet to be formed by the device, with said restricted portion comprising a sharpened inner peripheral edge adapted to trim a bullet ball of its excess sprue and size upon the ball being pressed through that trimming opening, with the ball aligned with said opening.

We slidably associate and hold the two base plates together, by placing them with the cylindrical half cavities molds side of each opposing the other, for thereby causing them to form a mold, having an opening at one end of the mold and closed at the other end thereof. We suitably hold the plates together on their dowell posts, such as by a pair of pliers, (not shown), as the molten lead is poured therein, because of the excessive heat. When there is sufficient cooling after the molten lead insert, we remove the two plates from their slidable posts and take out the cold formed lead sticks. Thus the base plate comprises a mold.

Figure 4:
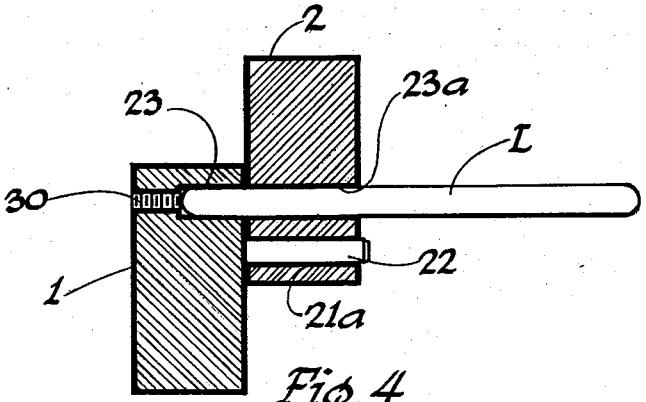

We then cut the desired lead slugs by operating our two circular dies on the base plate, as diagrammatically shown in our drawings, FIGS. 1, 2, 3 and 4, with die one held onto the base plates. The operation comprises placing our second die with one of its transverse openings slidably inserted over one of the transverse dowell pins of the first die as a pivot. Then a lead stick, as formed by the base plate mold, is threaded through aligned transverse holes in dies one and two entirely as far as predetermined by the setting of the limit plug of one of said openings. Then a handle is provided in the opening of the periphery of die 2 and pressure exerted counter-clockwise by that handle to thereby pivot die 2 with relation to stationary die 1 on the one pin pivot of die one, and in so pivoting die 2 it thereby shears off the lead in the lead hole of die 1, by die 2 being pivotally moved in abutment close proximity against die 1, as indicated in FIGS. 3 and 4.

Figure 11:
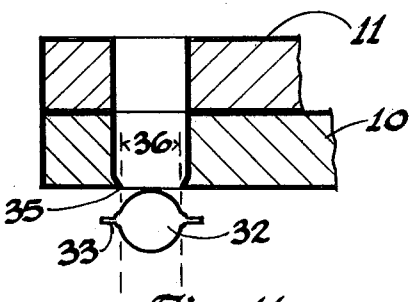

We thus form the lead sticks in the cylindrical cavities of our base plate as a mold, and then cut the lead sticks the desired length, by operating the circular dies on a pivot one slidably against the other to form a lead slug. Then we take the lead slug and insert it in the center of the opposing center cavity pair of dies, placing the one die on a flat surface, such as on the base plate, and the other die is threaded in alignment with the first die on the opposed diametrical dowell posts of the first die, by sliding the second die downwardly so that those posts of the first die fit into the openings of the second die, and then the two opposed center cavities of the abutting dies, with the lead slug centrally therebetween, are hammered together by a suitable hammer, such as by a lead or a brass hammer, until the surfaces of the dies are pressed flush together, and thus the desired bullet ball is thereby formed by the said half cavities. That cold formed ball is so preformed as shown in FIGS. 5–9 of the drawings, except for excess sprue and material thereon, as shown in FIGS. 8 and 10. That excess sprue and material is then removed by pressing the ball through the ball trimming and sizing opening in the base plates, as illustrated in FIG. 11.

The one-half ball cavities, formed in opposing sides of the two dies at the center of each, are to be noted as each having its peripheral rim slightly less, by about 3/1000ths of an inch, below the plane of its flat adjacent die surface. That is for the purpose of permitting some of the lead slug to be squeezed into the ring depression of that flat surface around the cavities upon the dies being pressured flush together, as illustrated and viewed in FIGS. 8 and 11. The depth of the lead stick opening in the first die is adjustable by a screw plug so as to control the volume of the lead slug to be cut off therein, as the second die rotates flush against the first die face as explained. That volume of that slug is purposely proportioned to be more than sufficient to form the desired ball as shown in FIG. 10, so as to have some excess of the lead material, when squeezed and formed between the dies as they are hammered together as shown in FIG. 8, to be able to form a solid fully formed ball thereby, and then the ball is exactly trimmed to the desired caliber size for use in a gun.

For example, to form a ball to be used in a 45 caliber muzzle loading rifle, the finished ball is desired to be 10/1000ths less than 450/1000ths of an inch, and so the ball, after formed by the two dies being pressed together, is then trimmed by our novel trimming cutter opening of the base plate to the exact desired 440/1000ths. The preformed ball is forced therethrough and thereby the sprue is cut and the ball cut to that desired diameter, by that trimming opening having its inner ring cutter edge of the exact desired finished ball size. The lead stick formed as explained, from which the lead slugs are cut, we preferrably form about 70/1000ths diameter smaller than the resultant ball desired to be formed as the finished ball. Each cavity of the opposing dies centrally of each die, by which the lead slug is formed upon the dies being pounded together, each are substantially a one-half cavity size of the desired resultant 440/1000ths diameter ball to be formed thereby. The peripheral edge of each central cavity, when the two dies are flush against each other, are formed to be separated slightly by about 4 to 6/1000ths of an inch, to permit a fully formed ball to be formed thereby and with sprue extending therefrom. Said sprue is later trimmed and the ball exactly cut to size, as explained. In muzzle loading rifles the diameter or caliber of the finished ball is 10/1000ths less than the bore or caliber diameter of the rifle, because on firing of the gun the ball is not forced into the grooves of the rifling but substantially rides on the rifling. Only the wadding or patch adjacent the ball, in the gun on ramrod loading, fits within the grooves between the rifling in the inner bore, and said patch effects the turning of the ball as the gun is fired.

DESCRIPTION OF INVENTION

From the foregoing summary, the advantages and objects of our invention are apparent. However, the following description of a preferred embodiment, as in the accompanying drawings, will better enable one skilled in the art to practice our invention.

In the drawings

Figure 6:
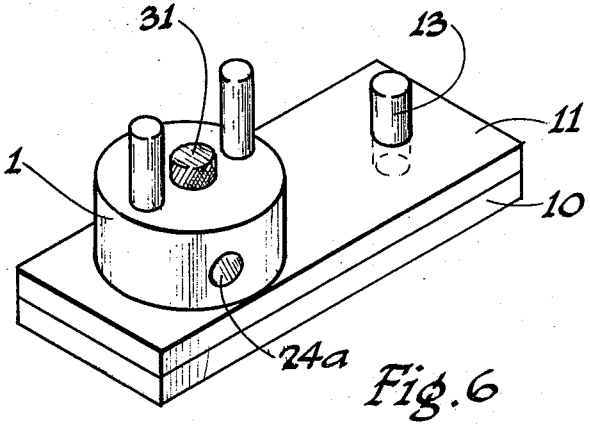
Figure 7:
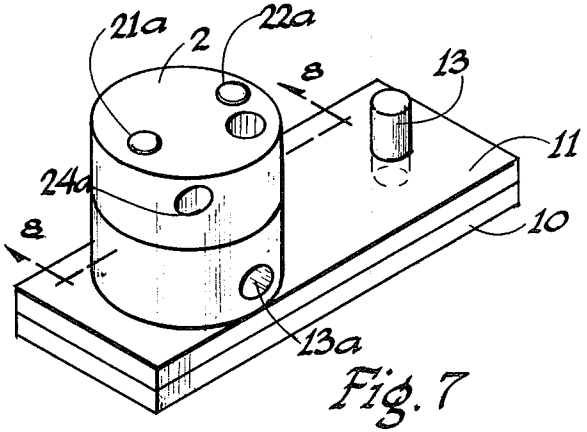
Figure 5:
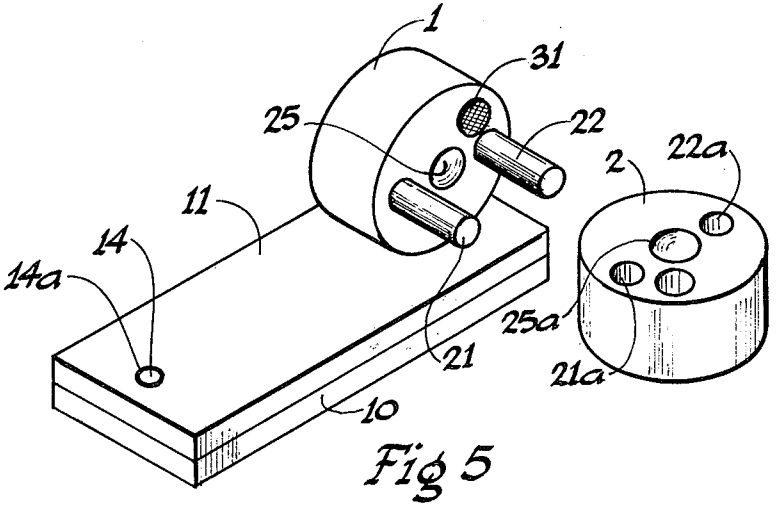
Figure 9:
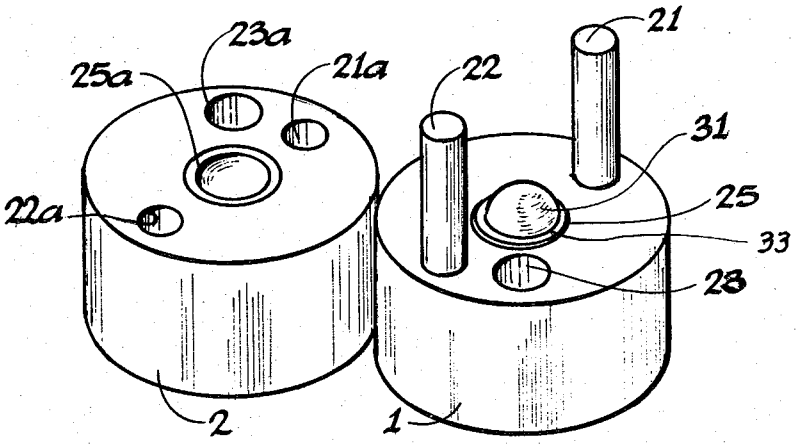
Figure 8:
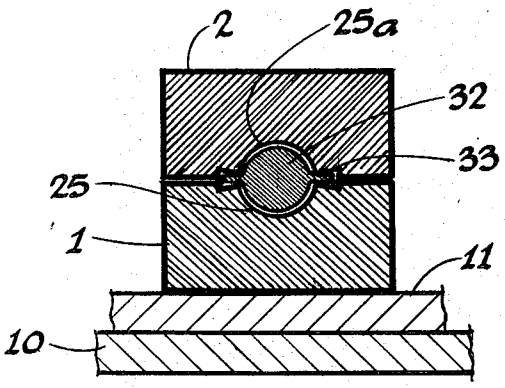
Figure 10:
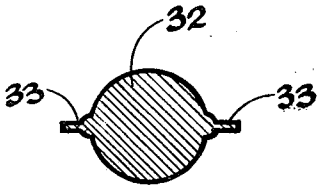

FIG. 1—is an unassembled inoperative perspective view of our tool;

FIG. 2—is a disassembled inoperative view thereof;

FIG. 3—is illustrative of the start of an assembled operative view of our device, with a lead stick in position to be die sheared off, but before the counter-clockwise operation handle caused die 2 eccentric pivoting in the direction indicated;

FIG. 4—is a vertical cross-sectional view taken on the lines 4—4 of FIG. 3, looking in the direction of the arrows, to illustrate the positioning of the dies and the lead stick ready to be sheared off upon such pivotal movement of die 2;

FIG. 5—is illustrative of the next step after the lead pin has been sheared off by such die operation, showing the dies after die 2 is taken from its pivot dowell pin of die 1, and showing the cut off lead slug 31 left in the opening of the first die;

FIG. 6—is a similar view to FIG. 5, except that the first die has been removed from its base plate post and placed flat on its outer flat surface with its inner flat surface having its parallel dowell pins facing upwardly, and showing the cut off slug 31 placed in the half cavity of its center upper surface ready to be crushed and formed into the desired ball;

FIG. 7—is illustrative of the step of the placing of the second die with its adaptive dowell pin openings slidably over the upwardly extending dowell posts of the first die and thus its center half bullet forming cavity on the slug ready to be crushed between the two aligned dies;

FIG. 8—is a vertical enlarged cross-section view taken on the line 8—8 looking in the direction of the arrows of FIG. 7, to show the formation of the desired ball and its sprue thereof as formed after the pounding of the second die down upon the first die with that lead slug 31 between and formed by the opposing ball-forming cavities;

FIG. 9—shows the two dies separated and enlarged, with the preformed ball of FIG. 8 before its trimming resting in the one die central one-half cavity;

FIG. 10—is an enlarged side view of the preformed ball by itself, with its protruding sprue and excess material before it is trimmed; and FIG. 11—is an enlarged vertical cross-sectional view of base plates of FIG. 2, showing how the ball is placed on a comparatively soft surface and then the base plates having the aligned ball trimming and sprue excess cutting opening formed therethrough is placed with that opening over the ball, with the plate ready to be pressed down and thereby the ball trimmed and the sprue eliminated, by the inner exact desired size cutting inside peripheral edge of the trimming opening as the ball is thereby forced up into the opening.

Referring more particularly to the drawings, we have a pair of like flat steel base plates 10 and 11, with each plate having one or more similarly placed elongated aligned cylindrical one-half cavities 12 formed therein on one side thereof. Cavities 12 are formed and positioned so that when the plates are placed together with cavity 12 sides together that the cavities are aligned and act as complete cylindrical mold tubes open at one end and closed at the other end, in which molten lead can be poured. The plates are held together slidably by upstanding posts 13 and 14 secured to one plate 10, and with a correspondingly placed and size openings 13*a* and 14*a*, respectively, formed in plates 11, adapted to fit slidably removably over those posts. A like ball shearing or trimming opening 15, of diameter and use to be explained, is formed in each plate, so as to be aligned when the plates are placed together slidably on the said posts 13 and 14.

We provide two identical circular flat dies, 1 and 2, of low carbon cold rolled steel, with each preheat treated to cause longevity of use by subjecting each to a 10,000 depth heat treatment. First die 1, has a radial opening 13*a* formed to lead from its periphery inwardly sufficiently to fit slidably over the post 13 of base plate and 2 are so pounded together, as shown in FIG. 8. That peripheral depression of each bullet cavity edge of each die is about 3/1000ths of an inch below the surface plane of its adjacent die surface, for the purpose of permitting some of the lead slug to be forced out into the thereby space between opposing peripheral cavity edges, as the two dies are ram-abutted closely together, as shown in FIG. 8. That excess material is both a slight bulging and also a sprue thin peripheral central edge indicated as 33.

Then we trim the excess sprue material 33 and bulging just explained, from that preformed spherical bullet ball by means of the trimming opening 15, formed through the base plates. We place the preformed ball 32 with its excess material, 33, on a comparatively soft surface, such as a wood surface, and then we hand or otherwise press the combined aligned plates 10-11 down over that ball, when the ball is aligned under trimming opening 15. As explained, the trimming opening 15 of 10 is of larger diameter than the desired final ball to be trimmed, but the trimming is accomplished by the lower inner reduced cutting edge of that opening 15 slightly slanting inwardly to form a reduced cutting edge opening 35. Opening 35 is of the exact diameter size of the desired bullet ball to be finished. Thus when the plate is forced down over the ball the trimming edge 35 cuts off the extra material 33 from the spherical periphery of the lead ball 32, as illustrated in FIG. 11.

We adjust the size or volume insert of the lead stick into opening 23 of die 1, by means of adjustment of the screw plug 30. That volume of slug is determined by trial and error until the right quantity of a slug is thereby formed upon operation of the dies, so that upon the compressing of the dies 1 and 2, as shown in FIG. 8, as explained, that there is some excess material formed into the extended peripheral opening around each ball cavity of each die as shown in FIGS. 8 and 10. That is necessary in order to have a completely full and solid ball finished 32. Then that excess material is trimmed off as explained in the forming of the final ball.

It should be further understood in use, that in muzzle loading rifles the operator rams the patch with the said ball down in the barrel, after the powder load and without another patch as rammed into the barrel. That the patch is the one which rides into each rifle groove between the rifling upon firing of the rifle and that the ball does not become deformed between those grooves. The ball rides on the rifling and is of the exact diameter from ridge to ridge in the rifle bore and that is why the ball is formed by our method to be 10/1000ths finished size smaller than the actual caliber bore of the rifle between rifle grooves. Thus a 45 caliber ball is formed 440/1000ths inch diameter for use with a 45 caliber bore gun.

Having thus explained and described a preferred embodiment of our invention, we wish it to be understood that many changes and modifications may be made therein without deviating from the spirit, scope and intent of our invention, and we therefore wish to be bound only by the hereunto appended claims.

What we claim and desire to secure by Letters Patent is:

1. A bullet ball tool for casting, shearing and molding bullet balls comprising, in combination, a separable base having a cylindrical cavity therein adapted to receive molten lead in the cavity for forming a lead stick, a pair of circular flat sided dies, with a first one of said dies having a first pivot pin means secured to and extending at a right angle from a flat side thereof, and the second of said dies having a transverse opening formed therein for adapting said second die to be thereby mounted rotatably and removably upon the pivot pin means of the first die by the second die being removably mounted with its said opening slidably over the said pivot pin of the first die for adapting the second die to be pivotally moved on said first die pivot pin means and with the dies in flat side abutment with each other, an upstanding second pivot pin means secured to the base plate, the first die having a radial opening formed in its periphery for permitting said first die to be mounted on said plate second pivot pin means by said first die radial opening being slidably removably mounted on said second pivot pin means, each of the dies having an aligned equal radial distance transverse like opening adapted upon a certain pivotal position of the second die on the first pivot pin means of the first die to be aligned and to receive a lead stick inserted therethrough both transverse openings when so aligned, handle means secured to the periphery of the second die for thereby effecting manual pivotal rotational movement of the second die on the first pivot pin means of the first die in a direction to cause a cutting of the lead stick by such movement of one of said dies with relation to the other of the dies upon such pivoting and upon a lead stick insert into both of said transverse openings.

2. A bullet casting, shearing and molding tool comprising, in combination, a base plate having a cylindrical mold therein for formation of a lead stick upon pouring of molten lead into said mold, a pair of flat disc dies removably pivotally associated together by a first pivot post means on one side of one disc and the other disc having an opening formed in one of its sides adapted for pivotally fitting over said pivot post means for rotation of the one disc with relation to the other disc with their flat disc side surfaces in abutment, a second post means securred to said base plate, the one disc having a radial opening inwardly of its periphery for adapting the one disc to fit slidably over the base plate post to removably secure and hold the one of said discs against rotation upon rotation of the other disc, each of said discs defining a pair of equal radial distance like transverse holes adapted to be aligned upon a certain pivotal rotation of the one disc on said first pivot post means with relation to the other disc and adapted to receive a lead stick therethrough when so aligned, each of said discs having a central substantially one-half ball cavity formed centrally of each on its said abutting side, whereby upon rotation of one of the discs with relation to the other disc and with a lead stick in said transverse holes the discs cut said lead stick and leave a slug portion thereof in said opening of the first die, and whereby upon disassembling of the discs and placing of the one disc on a flat surface with its cavity upwardly and placing the lead slug portion within its central cavity and then placing the other disc on top of that one disc and with said slug under the other disc cavity, then the discs are adapted for a hammering of the second disc downwardly to thereby form a bullet ball between said aligned disc cavities.

3. A bullet tool combination as defined in preceding claim 2 and defined further by the definition of each of said central bullet ball cavities of each disc having its inner periphery short of the extended flat adjacent surface plane line of its disc, whereby upon a pounding of the one disc on top of the other with a lead slug therebetween the two cavities of the discs to thereby form a 10-11, and thereby to hold die 1 removably in position on the base plates as shown in FIGS. 1 and 3. That first die 1 has a pair of fixed round diametrically opposed dowell pins 21 and 22 extending outwardly from a flat side thereof in parallel arrangement and fixedly secured thereto, as illustrated. Dowell pins 21 and 22 are preferably one-quarter inch in diameter and are of similar hardened steel material. On the flat side of die 1 having those pins and centrally of that side and between the pins, we form a one-half ball cavity 25, of half the desired ball caliber diameter for the ball to be formed, as will be explained. That cavity is formed by drilling with a round end drill and then conventionally ramming or bobbing a hardened desired size ball by about 30 tons of pressure into that cavity to form the cavity perfectly of one-half ball desired dimension, for the forming of a ball, by a similar aligned cavity in the other die 2, and when the two dies are rammed together, as will be explained. Die 1 has a transverse hole from flat side to flat side therethrough near the periphery thereof, indicated as 23, adapted to receive a lead stick inserted therein. An adjustable operable screw bolt 30 is provided in opening 23 at the opposite end of opening 23, from pins 21 and 22, for operably thereby limiting a lead stick insert into that opening 23 from its other side, to control the length size of the lead stick to be cut off as such a stick is held within 23 opening when the two dies are operated rotatably eccentrically in flat side abutment one against the other, as illustrated by FIGS. 3 and 4, and as will be explained.

Second die, 2, has a pair of diametrically opposed and spaced apart openings 21*a* and 22*a* formed transversely from flat side to flat side therethrough, of a dimension and spacing to permit the dowell pins 21 and 22 of die 1 to be aligned and in a certain operation slidably inserted therein, when die 2 is so removably held slidably thereon against die number 1, as shown in FIG. 7. Second die 2 has a similar central one-half ball cavity 25*a*, to 25 of die 1, formed in its center, between said two openings 21*a* and 22*a* on its flat face, with said cavity being adapted to be a bullet one-half ball cavity mold form, as previously explained with relation to the similar cavity 25 of die number 1. The second die has a transverse third hole 23*a* formed transversely therethrough near its periphery. 23*a* is positioned so that when die number 1 is removably and slidably held on post 13 in die 1 opening 13*a*, as in FIGS. 1 and 3, and with die 2 pivotally slidably operably held flat side to flat side onto die 1, by dowell 22 of die 1 slidably extending in opening 21*a* of die 2, as an eccentric pivot of die 2 on die 1, that the said opening 23*a* of die 2 can then be aligned with opening 23 of die number 1, by eccentrically rotating die 2 on pivot 22 pin with relation to die 1 to effect such alignment. The radial distances from 22 to 23 is the same as the distance from 21*a* to 23*a*. Said opening 23*a* is adapted to permit a lead stick to be inserted therethrough and on into opening 23 of die 1, upon such alignment and operation of the device, so as to cut off slugs of that lead stick on die operation, as will be explained. Second die 2 has a peripheral radial opening 24*a* adapted to receive a handle member 24 slidably inserted down therein, for reason to be explained. Said opening 24*a* is on the peripheral area of that die 2 substantially adjacent to the lead stick opening 23*a*.

Separable base plates 10 and 11 are slidably removably frictionally held together by means of the posts 13 and 14 extending through their respective aligned mating openings 13*a* and 14*a*, when plate 10 is rested on a flat surface and plate 11 is placed thereover with said posts so inserted within said openings. We provide ball trimming openings 15 formed in each of those base plates 10 and 11 formed completely therethrough and aligned as shown, for purpose of being an aligned complete opening when said plates are so secured together. Said openings 15 are larger than the desired finished ball to be formed by the device, however, at the extreme lower end of the lower plate opening 15 we provide a reduced neck inner periphery having a substantial sharp inner peripheral edge indicated as 34. The inside diameter of said reduced neck inner edge opening is the exact diameter desired for the finished ball to be made by the device, as will be explained.

We construct the opposing one-half central ball mold cavities, in each die 1 and 2, with the peripheral edge or inner rim of each cavity formed slightly below the plane of the surface of its flat side of the die. Such is about 3/1000ths of an inch distance short of being parallel with that die side adjacent plane, for purpose to be explained.

We form lead sticks by pouring molten lead into the cylindrical mold cavities 12 of the base plates, when the base plates are held together as shown in FIG. 1, and additionally held by a pair of pliers to avoid finger burning when the molten hot lead is poured therein. The molten lead is poured through the open ends of said cylindrical mold openings 12 when those plates are so held together. When the lead cools then the plate posts 13 and 14 are rapped to cause vibration and thus the plates can then be separated and the cooled lead sticks removed. Then we cut off a lead stick into desired size lead length slugs, of the dimension needed to be able to form gun balls therefrom. We then insert a lead stick, indicated as L, within aligned openings 23 and 23*a*, aligned as heretofore explained for that purpose, when die 2 is pivotally operated on its eccentric pivot 21*a*–22, as heretofore explained, as shown in FIG. 3. That die 2 is rotated until opening 23*a* is aligned with opening 23 of 1 and the lead stick L inserted therethrough and as far into opening 23 of die 1 as controlled by the adjustable plug screw pin 30 of 23. Handle 24, inserted in its opening 24*a* of die 2 is then pulled counter-clockwise, with relation to said pivot 22-21*a* and with the die flat surfaces abutting each other, and thereby the inner edge of opening of 23*a* of die 2 abutting flat against the side face of die 1 will shear off the lead stick L as opening 23*a* moves beyond opening 23 of die 1, thus leaving a lead slug, indicated as 31, within the opening 23 of die 1, as illustrated in FIGS. 3, 4 and 5.

Die 1 is then placed flat with its dowell pins 21 and 22 upwardly upon the base plate 11, and the slug 31 is placed in the bullet cavity 25 of die 1. Die 2 is then placed over die 1 with the openings 21*a* and 22*a* respectively of die 2 slidably placed over dowell pins 21 and 22 of die 1, for thus aligning the bullet forming central cavities 25 and 25*a*, as illustrated in FIG. 7, in opposition to each other. A suitable shot, brass or lead hammer, is then used to hit the upper surface of die 2 which then compresses the two dies together to form the desired formed ball, as 32 illustrated in FIG. 8. FIG. 9 shows that formed ball 32 after the two dies are separated, and before 32 is removed from one die.

As explained, bullet cavities 25 and 25*a* of dies 1 and 2, respectively, have their peripheral half ball cavity edges slightly below the plane surface of their adjacent flat side of their respective dies, to permit a slight bulging and sprue material formation 33 as the two dies 1 bullet ball of the slug a surplus of lead will sprue outwardly at the diametrical periphery of the so-formed bullet ball, and said base plate having a trimming opening formed therein and extending therethrough with the inner peripheral edge thereof formed as a sharp trimming-cutting means for trimming of the bullet ball to size when the bullet ball is forced therethrough.

4. A bullet device, for casting, shearing and molding bullet balls, having:

a separable base plate of two plate members with one plate member having a pair of right angular projecting posts, and the other plate member having reciprocally located formed openings therethrough adapted for permitting said posts to extend slidably therein, with one said post extending through and beyond its corresponding opening, and with the plate members removably held together with a flat surface of each plate member in abutment with the other, each of said abutting flat surfaces having a like cylindrical half mold cavity formed therein of opposing placement adapted upon such surfaces' abutment together to comprise a mold form of a tube closed at one of said cavity ends and open at the other of its ends adapting said abutted mold tube to receive molten lead poured therein for forming a lead stick thereby;

a like pair of flat circular hardened dies, with a first die having a pivot pin means secured to and extending outwardly from a side of the first die adjacent its periphery, and the first die having a peripheral cylindrical radial opening formed therein adapting the first die to be placed with said opening slidably on and removably over said extended post of the one plate member and to be held by that post thereon when that die is so placed thereon, the second die having a pivot opening transversely formed therethrough adjacent its periphery and adapted to have the second die slidably and rotatably held on and by the first die pivot pin means extending through said transverse opening of the second die, said pivot pin means of the first die and the transverse opening of the second die comprising pivot means for operably mounting the second die on the first die and for permitting pivotal movement of the second die with relation to the first die with the flat sides of the two dies in abutting flat surfaces contact with each other, a handle means on the periphery of the second die in a position substantially remote from said pivot pin means of the two dies and adapted for manual applied pressure by the handle means to cause pivotal movement of the second die on said pivot means of and with relation to the first die, an aligned pair of transverse like equal radial distant openings formed through said two dies when the two dies are so aligned pivot means connected in a certain pivotal position together with said openings when so aligned being adapted for receiving a lead stick therein, an adjustable screw plug in said lead stick opening of the first die at its opposite side from the second die and adapted for screw adjustment of the area of said opening within said first die, whereby upon a pivotal movement of the second die on said pivot means upon a manually caused rotation thereof with a lead stick within said aligned transverse openings of both dies thereupon a shearing of said lead stick is adapted to be effected by said second die pivotal movement causing the abutting flat adjacent surfaces of the two dies to effect a disalignment of said two lead stick transverse openings and thereby and thereupon the lead stick portion of the lead stick in the opening of the first die will be cut off as a slug from said stick;

And each die having an identical central substantial half ball cavity formed therein and the dies being adapted, upon said lead slug being placed between said dies and their cavities and with a first one of said dies resting upon a flat solid surface and with its cavity having the slug uppermost therein and the second die resting upon said first die and slug and in cavity abutment alignment with the slug between cavities, upon sufficient downward pressure upon the top die for causing the top die cavity to be pressed down against said slug to form that slug into a bullet ball.

5. A method of casting, shearing and forming a bullet in a single bullet ball tool having a base plate having a mold opening for receiving molten lead therein for forming a lead stick, a pivotally associated together operable pair of flat die cutting discs having aligned transverse openings and removably carried by the base plate and eccentrically operably adapted for shearing lead slugs from a lead stick in said aligned openings, and with each of said discs having a bullet mold half-cavity in a flat side thereof adapted for forming a bullet of a slug placed between said cavities when the discs abut with their flat sides and cavities aligned and compressed together, said method comprising the steps of:

(a) molding a lead stick by pouring molten lead in the base plate mold opening and removing the lead stick when cooled, (b) cutting a lead slug from the lead stick by and upon operating the pair of flat cutting die discs, and (c) forming a bullet of the slug by causing the dies to be compressed together after placing the lead slug between aligned disc die cavities with the discs in flat abutment to each other.

6. The method of casting, shearing and molding bullet balls comprising the steps of:

(A) casting a lead stick by pouring hot lead within a mold of a base plate and removing said stick therefrom;

(B) placing the lead stick through aligned transverse openings of two dies after the dies are operably positioned on the base plate and one die is rotated with relation to the other to so align said openings, and then cutting a slug portion of the lead stick within said transverse opening of one of the dies by rotatably pivotally operating one die with relation to the other die to cause disalignment of said die transverse openings;

(C) removing the dies from their operative position on the base plate and from each other, and then placing one die on a hard flat surface and with the lead slug portion placed within its half cavity and with that die cavity uppermost and then inserting the other die flat down with its surface having its central cavity lowermost and aligned directly over that slug lead portion of the first die cavity, and then exerting sufficient ram pressure by a hammer or otherwise onto the top die to press the top die down on and over the slug lead portion between the die cavities of the two dies for thereby forming a bullet ball between said two cavities of said two dies; and (D) then placing the bullet so formed by such compression of the two dies in a position in alignment with a trimming opening of the base plate and forcing the bullet through that trimming opening to thereby trim excess sprue from the bullet ball to thereby effect the desired dimensional diameter size of said bullet.

7. The combination, in a single bullet ball tool, for casting, shearing and molding bullet balls, of a base plate having a mold opening therein for receiving molten lead therein for casting a lead stick, plural disc means removably pivotally operatively associated together and on the base plate and having co-acting cutting means for shearing lead slugs from a lead stick, and with each disc having a bullet mold cavity therein adapted for receiving a sheared lead slug in the cavities upon a certain removed disc positioning of the discs for disc forming said slug into a bullet upon a compression force exerted upon the discs with the slug in between the cavities.

* * * * *